United States Patent [19]

Johnson

[11] Patent Number: 4,483,089

[45] Date of Patent: Nov. 20, 1984

[54] HOLDER FOR PISTOL LOADER AND CARTRIDGES

[75] Inventor: David A. Johnson, Klamath Falls, Oreg.

[73] Assignee: J.F.S., Inc., Salem, Oreg.

[21] Appl. No.: 399,205

[22] Filed: Jul. 19, 1982

[51] Int. Cl.[3] ..... F42B 39/04

[52] U.S. Cl. ..... 42/89; 224/253

[58] Field of Search ..... 42/89, 88, 87; 224/239, 224/240, 253, 914

[56] References Cited

U.S. PATENT DOCUMENTS

| | | | |
|---|---|---|---|
| 2,396,184 | 3/1946 | Lima | 42/89 |
| 2,399,904 | 5/1946 | Baucum | 42/89 |
| 3,769,733 | 11/1973 | Nelson | 42/89 |
| 3,890,733 | 6/1975 | Kubik | 42/89 |
| 4,065,868 | 1/1978 | Johnson | 42/89 |
| 4,272,903 | 6/1981 | Griffis | 42/89 |
| 4,408,707 | 10/1983 | Rogers | 42/89 |

*Primary Examiner*—Charles T. Jordan

*Attorney, Agent, or Firm*—Chernoff, Vilhauer, McClung, Birdwell & Stenzel

[57] ABSTRACT

A cup-like protective carrying device for holding a pistol reloader of the type which carries a plurality of pistol cartridges arranged to be simultaneously inserted into the several chambers of a revolver cylinder has a generally cylindrical protective shell wall and a closed bottom from which a pair of elongate arms extend upwardly, passing between adjacent ones of the cartridges. A catch on each of the arms includes camming surfaces for engaging a portion of the revolver reloader, resiliently deflecting the arms to permit the catches to ride over the portion of the reloader and thereafter elastically engage the reloader to hold it within the carrier. Provision is made for riveting the carrier to a leather slide loop or a holster belt to carry a charged revolver reloader ready for immediate use.

11 Claims, 5 Drawing Figures

HOLDER FOR PISTOL LOADER AND CARTRIDGES

BACKGROUND OF THE INVENTION

The present invention relates to improvements in plural cartridge holders and is particularly directed to a protective holder for a pistol loader containing a plurality of cartridges ready for simultaneously loading all of the cartridges into the cylinder of a revolver.

It has previously been common for spare cartridges for a revolver to be carried individually in separate loops attached to the belt on which a pistol holster is carried. Individual cartridges must be removed from such loops and loaded into the cylinder of a revolver one at a time. Devices have recently become available which permit a plurality of cartridges to be simultaneously loaded into the cylinder of a revolver, greatly reducing the time required to reload. One such revolver speed loader is disclosed in Johnson U.S. Pat. No. 4,065,868.

In order to gain the benefits of such speed loaders, the speed loaders must be carried loaded with cartridges ready for immediate placement into the revolver. Such a speed loader, however, is significantly different in shape from a single cartridge and therefore cannot be carried in the loops of conventional holster belts. Previous to the present invention a speed holder has had to be carried in one's pocket or in, for example, a special leather case attached to a holster belt. Having to carry the speed loader in such a case reduces to some extent the speed loader's advantage of speed, since it takes a certain amount of time to open the case and thereafter remove the speed loader from the case. Such a special leather case is also somewhat costly and adds undesirable bulk to a holster belt.

While a speed loader provides some amount of protection for the cartridges held within it, the speed loader does not cover the entire length of each cartridge, and may even cover protectively less of the cartridge than the loops formerly used to carry individual cartridges on a holster belt. Cartridges in such a speed loader carried loosely in one's pocket may, then, be subjected to undesirable contact with other items, causing a risk of damage from which it is preferable to protect the cartridges.

What is desired, then, is an inexpensive holder for protectively holding a speed loader on a holster belt, with or without any cartridges contained therein, in such a manner as to prevent dislodgment of cartridges from the speed loader and to prevent damage to the cartridges. Such a holder should securely hold the speed loader and the cartridges contained in it, yet provide convenient removability and quick availability of the speed loader to reload a pistol when necessary.

SUMMARY OF THE INVENTION

The present invention provides an inexpensive holder for a pistol speed loader which may be conveniently attached to a pistol holster belt to securely carry a speed loader, regardless of whether it contains cartridges. The holder of the invention protectively encloses the bullets of any cartridges which are in the speed loader and holds the loader conveniently ready for quick use.

The pistol loader holder of the present invention includes a cup-like protective body or shell including a generally cylindrical upright wall having inwardly directed protuberances which fit between cartridges carried in a pistol loader, in order to properly orient the loader within the holder. The upper edge of the wall is located appropriately to mate against the lower surface of the pistol loader. A pair of retainer arms extend upwardly from a closed bottom of the cup-like protective shell to engage a portion of the pistol loader. The retainer arms include catches which resiliently grip a portion such as the forward star wheel of a pistol loader of the type disclosed in Johnson U.S. Pat. No. 4,065,868, to retain the pistol loader in the holder yet permit it to be removed by being pulled directly outward from the holder. A flat surface and appropriately spaced rivet holes are provided on the exterior of the protective shell in order to permit the holder to be attached to a loop for attachment to a holster belt, or to be directly riveted to a shoulder holster belt.

It is therefore a primary objective of the present invention to provide an improved holder mountable on a belt for securely and conveniently carrying a pistol loader containing cartridges ready for loading into a revolver cylinder.

It is another important objective of the present invention to provide a holder for a pistol loader and cartridges, from which the pistol loader and cartridges can be quickly removed yet will not inadvertently become dislodged.

It is yet a further objective of the present invention to provide a holder which cooperates with a pistol loader to protect cartridges carried therein from damage.

It is an important feature of the present invention that it provides a holder having a pair of resilient arms equipped with catches for releasably gripping a portion of a pistol loader to securely and protectively hold the loader.

It is another feature of the holder of the present invention that it includes a protective cup-like shell which surrounds portions of the cartridges which otherwise are exposed when the cartridges are contained in a pistol loader.

It is an important advantage of the present invention that it provides a holder which makes a pistol loader more easily and quickly available for use than previously available carrying cases.

It is another important advantage of the holder of the present invention that it provides better protection of cartridges carried in a pistol loader than is provided by carrying the charged loader in a garment pocket or in a leather case attached to a holster belt.

It is yet a further advantage of the present invention that it provides a protective holder for a charged pistol loader which is less expensive to manufacture than previously known cases for such pistol loaders.

DETAILED DESCRIPTION OF THE DRAWINGS

Figure 1:
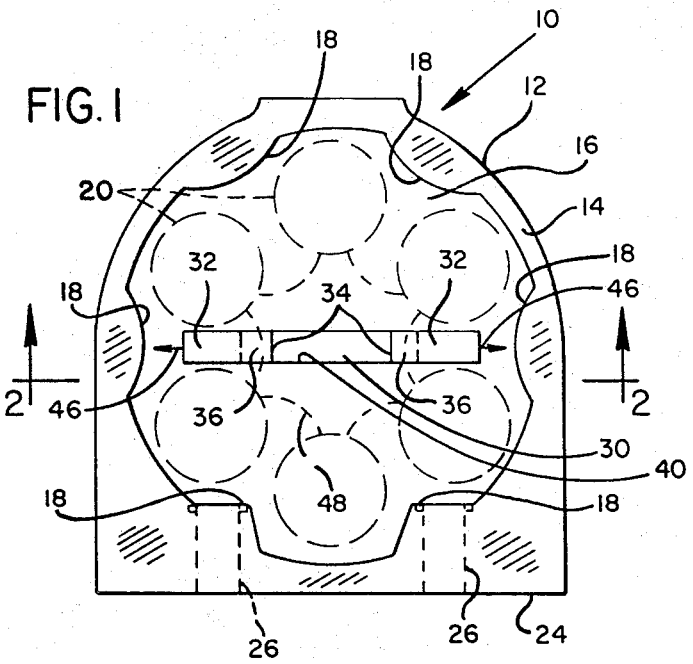
FIG. 1 is a top plan view of a holder for a pistol loader embodying the present invention.
Figure 2:
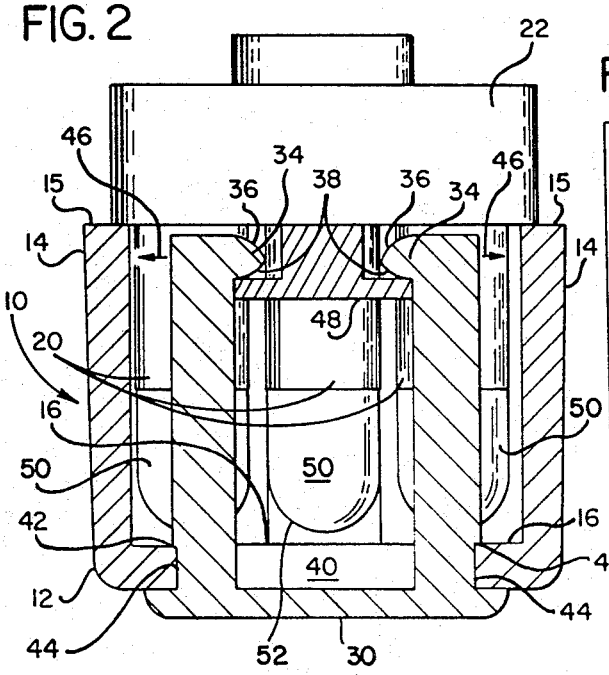
FIG. 2 is a sectional view of the holder shown in FIG. 1, taken along line 2—2, and showing a charged pistol loader in the holder.

Referring now to FIGS. 1 and 2 of the drawings, a holder 10 may be seen to include a protective shell 12 having an upright, generally cylindrical wall 14 and a generally flat bottom 16. The interior of the shell 12 includes a plurality of protuberances 18 extending inwardly from the wall 14 to define an equal number of storage positions for receiving cartridges 20 held in a pistol loader such as the loader 22. A back 24 of the protective shell 12 is generally flat and defines a plurality of rivet holes 26. The shell 12 is preferably of a hard plastic material such as a polycarbonate resin which is light in weight, easily moldable, and has sufficient strength and shock resistance to efficiently protect cartridges contained therein against damage should the holder 10 be dropped.

Figure 3:
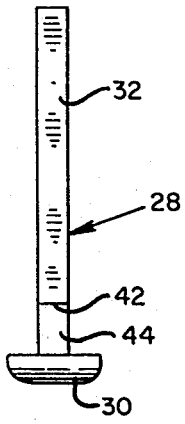
FIG. 3 is a side elevational view of the retainer portion of the holder shown in FIG. 1.
Figure 4:
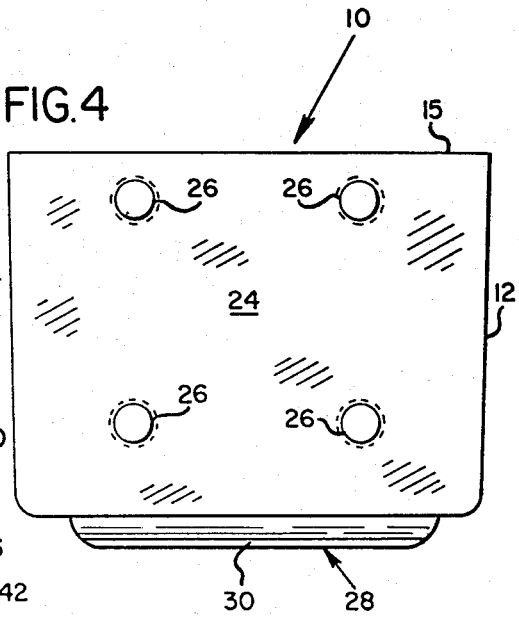
FIG. 4 is a rear elevational view of the holder shown in FIG. 1.

Referring now also to FIGS. 3 and 4, a retainer portion 28 of the holder 10 may be seen to include a base 30 and a pair of generally parallel arms 32 extending upwardly from the base 30. The arms 32 are thin enough to conveniently fit between adjacent cartridges held in a loader 22 in proper relationship with one another for simultaneous insertion into the cylinder of a pistol. Each arm 32 includes a catch 34 having respective upper and lower camming surfaces 36 and 38. Each of the arms 32 extends upwardly through a slot 40 defined in the bottom 16 of the shell 12 and includes a retainer catch 42, defined by a recessed portion 44 on the outer surface of each arm 32. The retainer 28 may be of a plastic resin material, and the base 30 is resilient enough to permit the retainer catches 42 to be pressed toward one another during insertion of the retainer 28 upwardly through the slot 40. When the retainer 28 has been inserted far enough into the body 12, the retainer catches 42 engage the upper interior surface of the bottom 16, with the portions of the bottom 16 which define the ends of the slot 40 fitting within the recessed portions 44.

The arms 32 are sufficiently resilient to move outwardly as indicated by the arrows 46 when an outer star wheel 48 of the pistol loader 22 engages the upper camming surfaces 36 as the loader 22 is pushed into the holder 10. When the loader 22 is fully inserted into the holder 10, the loader catches 34 resiliently return toward one another, allowing the lower camming surfaces 38 to engage the star wheel 48 of the loader, securely holding the loader 22 mated with the holder 10, with the body 23 of the loader 22 in contact with the upper edge 15 of the wall 14. Cartridges 20 held within the loader 22 are thus cooperatively, protectively and securely contained within the loader 22 and the holder 10. Preferably, the depth of the interior of the shell 12 is sufficient to provide a small amount of clearance between the nose 52 of the bullet 50 of each cartridge 20 and the bottom 16 of the body 12.

Figure 5:
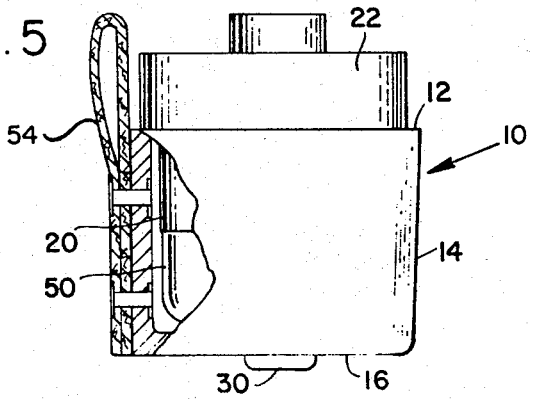
FIG. 5 is a partially cut-away side elevational view of the holder shown in FIG. 1, on a reduced scale.

Referring now to FIG. 5, it may be seen that one way to attach the holder 10 to a pistol holster belt is to use a leather loop 54 riveted to the back 24 of the protective shell 12. Alternatively, the back 24 may be riveted directly to a holster belt or strap. This may be preferable for attachment of the holder 10 to the strap of a shoulder holster. For increased convenience and easier removability of the loader 22 from a holder 10 used with a shoulder holster it is recommended that the holder 10 be attached to the strap of a shoulder holster in a position inverted from that shown in FIG. 5.

Removal of a loader 22 from the holder 10 of the present invention requires merely that the loader be grasped and pulled directly outward from the holder 10 with sufficient force that the star wheel 48 pressing against the lower camming surfaces 38 will spread the arms 32 resiliently apart from one another, releasing the loader 22 from the holder 10.

It will be apparent that the holder 10 could be manufactured as a unitary molding including the arms 32, instead of separately molding the retainer 28 and attaching it to the body 12 by insertion through the slot 40, without departing from the present invention.

It will also be apparent that the length of the arms 32 and location and orientation of the catches 34 may be altered to accomodate various pistol loaders without departing from the invention.

The terms and expressions which have been employed in the foregoing specification are used therein as terms of description and not of limitation; and there is no intention, in the use of such terms and expressions, of excluding equivalents of the features shown and described or portions thereof, it being recognized that the scope of the invention is defined and limited only by the claims which follow.

I claim:

1. A protective holder for use in carrying a pistol reloader and any cartridges contained therein in readiness for loading the cartridges into a cylinder of a revolver, the holder comprising:
   (a) a generally cup-like protective shell including a generally cylindrical wall and a bottom connected to said wall adjacent an end thereof; and
   (b) resilient retainer means extending within said protective shell from said bottom, for releasably engaging said reloader and holding said reloader mated with said holder, with said cartridges protectively housed in said reloader and said protective shell, yet permitting removal of said reloader and cartridges upwardly from said holder.

2. The holder of claim 1 including attachment means for mounting said cup-like protective shell on a belt.

3. The holder of claim 1 wherein said retainer means includes a pair of elongate resilient arms extending upward from said bottom in locations permitting the arms to fit between adjacent ones of said cartridges contained in said reloader, each arm including an upper end and a catch adjacent thereto.

4. The holder of claim 1 wherein a body portion of said pistol reloader abuts against said generally cylindrical wall when said pistol reloader is held in engagement with said holder, said cup-like protective shell cooperatively and protectively enclosing said cartridges within said holder and reloader.

5. A protective holder for use in carrying a pistol reloader and any cartridges contained therein in readiness for loading the cartridges into a cylinder of a revolver, the holder comprising:
   (a) a generally cup-like protective shell including a generally cylindrical wall and a bottom connected to said wall adjacent an end thereof;
   (b) resilient retainer means extending within said protective shell from said bottom, for releasably engaging said reloader and holding said reloader mated with said holder, with said cartridges protectively housed in said reloader and said protective shell, yet permitting removal of said reloader and cartridges from said holder; and (c) a pair of elongate resilient arms included in said retainer means, said arms extending upward from said bottom in locations permitting them to fit between adjacent ones of said cartridges contained in said reloader, each of said arms including an upper end and a catch adjacent thereto.

6. The holder of claim 5 wherein said bottom includes a slot extending therethrough, and wherein said retainer means includes a base portion from which both of said arms extend and retainer catch means on each arm for holding said retainer means attached to said body with said arms extending within said shell through said slot.

7. The holder of claim 6, wherein said protective shell is of a rigid shock-resistant material and said arms of said retainer means are of a more flexible material.

8. The holder of claim 5, wherein said shell includes protrusions directed generally radially inward of said shell wall and appropriately spaced apart to fit between portions of said cartridges.

9. The holder of claim 5, wherein said catches protrude radially inward from said arms and include camming surface means for being forced radially outward by said reloader as said reloader is inserted into or removed from engagement with said holder.

10. The holder of claim 5, wherein said catches are located appropriately to engage a centrally located member of said reloader extending within said protective shell.

11. The holder of claim 5 wherein a body portion of said pistol reloader abuts against said generally cylindrical wall when said pistol reloader is held in engagement with said holder, said cup-like protective shell cooperatively and protectively enclosing said cartridges within said holder and reloader.

* * * * *